United States Patent [19]

Coe

[11] 4,345,790

[45] Aug. 24, 1982

[54] WALKER WITH DETACHABLE SEAT

[76] Inventor: Martha D. Coe, 63 E. River Rd., Rumson, N.J. 07760

[21] Appl. No.: 165,701

[22] Filed: Jul. 3, 1980

[51] Int. Cl.[3] ..... A61H 3/04; A47D 13/04

[52] U.S. Cl. ..... 297/6; 297/45; 297/276

[58] Field of Search ..... 297/5, 6, 45, 276, 452, 297/453, 455; 280/7, 1; 108/149; 248/340; 272/85

[56] References Cited

U.S. PATENT DOCUMENTS

| | | | |
|---|---|---|---|
| Re. 21,773 | 4/1941 | Bank | 160/404 |
| 715,978 | 12/1902 | Carroll | 297/6 |
| 995,686 | 6/1911 | Koch | 248/340 |
| 1,032,243 | 7/1912 | Robertson | 297/455 X |
| 1,394,224 | 10/1921 | Scott | 297/6 |
| 1,448,783 | 3/1923 | Blewitt et al. | 297/6 |
| 2,339,007 | 1/1944 | Gahm | 297/5 |
| 2,557,269 | 6/1951 | Fox | 297/452 X |
| 2,728,617 | 12/1955 | Edwards | 272/85 X |
| 3,337,885 | 8/1967 | Crane et al. | 297/453 X |
| 3,354,893 | 11/1967 | Schmerl | 297/6 |

FOREIGN PATENT DOCUMENTS

| | | | |
|---|---|---|---|
| 667088 | 2/1950 | United Kingdom | 297/5 |

*Primary Examiner*—James T. McCall
*Attorney, Agent, or Firm*—Gordon W. Kerr

[57] ABSTRACT

Walkers are provided with an upholstered seat which can be suspended from a pair of horizontal members on opposite side of the walker frame, so that the user may rest when not walking. The seat is comfortable, safe and can be stowed on the walker when not needed or completely removed. Such seats can be sold separately and easily retrofitted to existing walkers.

7 Claims, 6 Drawing Figures

FIG. 3
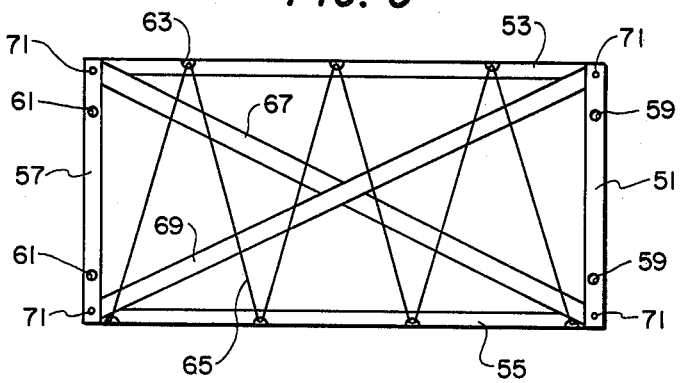
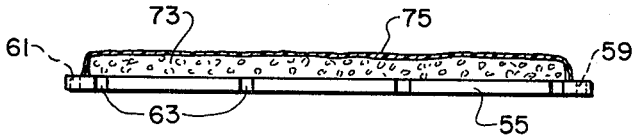
FIG. 4
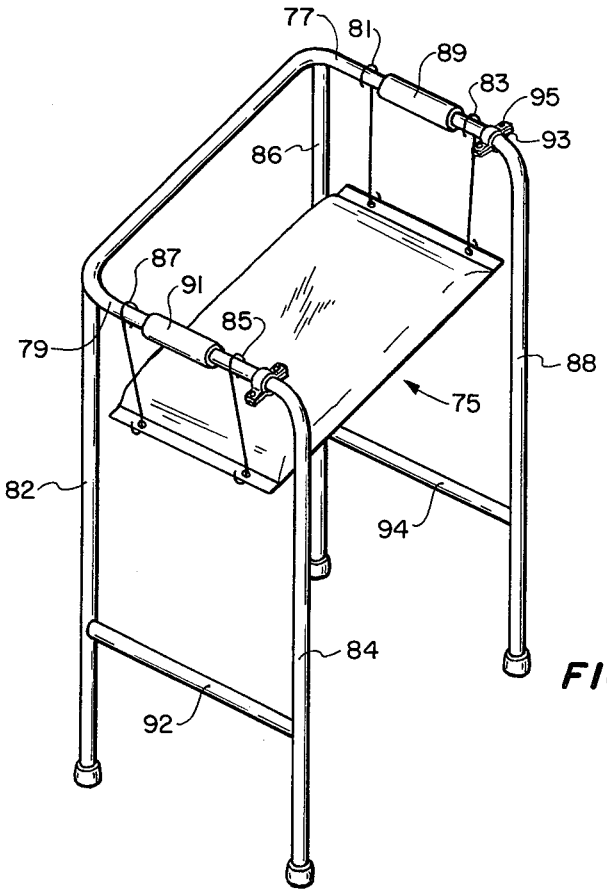
FIG. 5
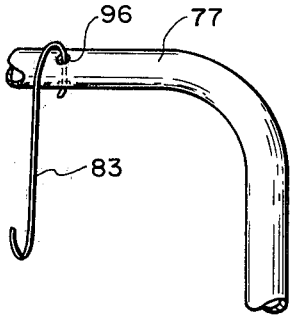
FIG. 6

WALKER WITH DETACHABLE SEAT

BACKGROUND OF THE INVENTION

The field of this invention is walking aids which are required by persons with walking disabilities requiring more support than is provided by a cane or crutches. Such devices, called walkers, are well known in the art and invariably comprise a three sided framework usually of tubular metal with handgrips located at the top of the left and right side frame members. The user, grasping the handgrips, walks into the space formed by the three sides of the device and then raises it and places it in a forward position. The user than walks to the forward position still grasping and handgrips, and then repeats this cycle.

The present invention comprises a walker of the type described which is equipped with a seat on which the user may rest when not walking. The seat is designed so that an invalid with limited use of his legs may safely, easily, and comfortably seat himself and arise when he desires to resume walking. The seat is designed so that it can be retrofitted to many existing walkers either with no modifications or with only slight modifications. Also, the seat may be easily stowed on one side of the walker frame when not needed, or it can be completely removed. The seat may be used with a well known folding walker and when in the stowed position thereon, it will not interfere with the folding thereof.

Walkers have been equipped with seats in the past, for example see U.S. Pat. No. 2,798,533, Frank; U.S. Pat. No. 2,872,967, Kirkpatrick; U.S. Pat. No. 3,993,349, Neufeld; and U.S. Pat. No. 4,162,101, McCague et al, however the present walker has important features and advantages not found in any of these prior art walkers.

SUMMARY OF THE INVENTION

The walker of the present invention includes a seat adapted to be mounted or suspended from two horizontal members on opposite sides of the framework which comprises the walker. In a preferred embodiment the seat comprises a rectangular frame of flat aluminum stock with diagonal bracing. The long side of this rectangular frame is made slightly shorter than the interior horizontal dimension across the inside of the walker, and is made approximately half as wide as it is long. This provides a seat approximately 8 times 16 inches for most walkers, and such a seat has an area large enough to comfortably and safely support even obese persons. The seat is upholstered with a cushion and a cover. The seat frame is exposed on both short sides thereof and a pair of holes are provided at each such side for suspending or mounting the seat from the aforementioned horizontal members. The suspension means may comprise simply two pairs of S-shaped hooks, one pair having their lower ends engaging the two mounting holes at one end of said seat and the upper ends hooked around the horizontal member on one side of the walker, with the other pair of hooks similarly engaging the two mounting holes at the other end of the seat and the corresponding horizontal member at the opposite side of the walker frame. The lengths of the hooks are chosen to provide a desired seat height, and different length hooks can be provided with each seat sold to accommodate users of different heights or seat height preferences. Other suitable means for suspending the seat between the opposed horizontal members may be utilized.

When the seat is no longer needed, the pair of hooks or other suspension means on one side thereof are disconnected from the horizontal member and the seat with its hooks allowed to hang down on one side of the walker. In this stowed position the walker can be used for its intended purpose and folding type walkers can be folded with the stowed seat thereon. The seat can also be completely removed, if so desired.

Some walkers comprise only two horizontal members on each side, with the lower one too close to the ground for the mounting thereon of a seat. Also many of the upper horizontal members of such walkers are angled slightly downward toward the user and thus a hook would slide off these members if not suitably restrained. On such walkers, the seat is suspended from these upper horizontal with extra long suspension means, and with a restraining means added to such upper horizontal members to prevent slippage of the suspension means.

BRIEF DESCRIPTION OF THE DRAWINGS

FIG. 3 shows the seat frame without its cushion and cover.

FIG. 4 shows a cross section of the upholstered seat.

FIGS. 5 and 6 show how the seat can be easily retrofitted to a common type of non-folding walker.

DETAILED DESCRIPTION OF A PREFERRED EMBODIMENT

Figure 1:
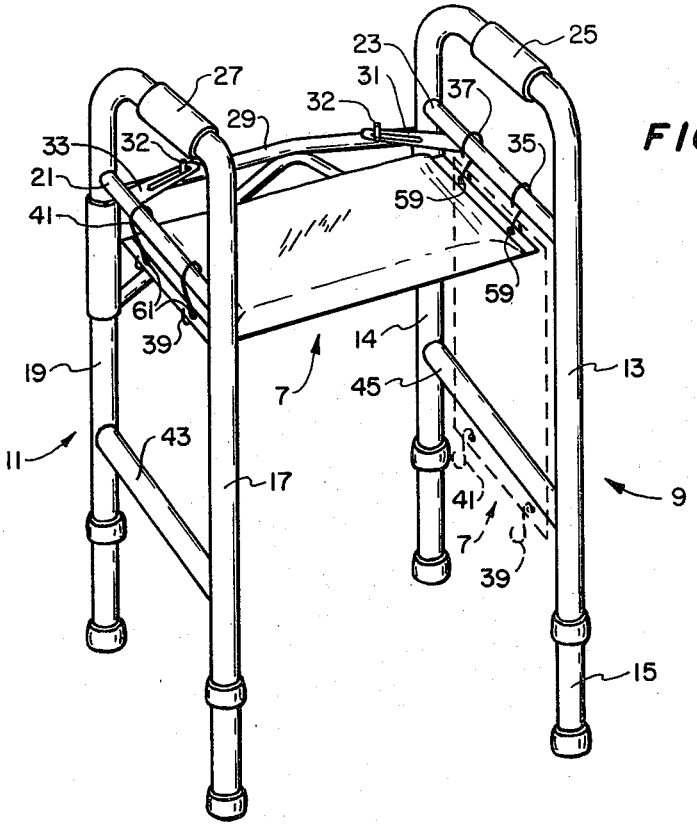
FIG. 1 shows a folding type walker, unfolded, with the seat installed.

FIG. 1 shows a well known folding walker manufactured by the Guardian Products Co., which has been retrofitted with a seat in accordance with the present invention. One end of the seat 7 is suspended within the walker by means of a pair of S-shaped hooks 35 and 37, having their upper ends hooked around the horizontal member 23 of the right side frame 9 of the walker, with the other ends of these hooks engaging two holes 59 in the end of the frame of seat 7. Similarly, the other end of the seat is suspended by means of hooks 39 and 41 on the horizontal member 21 and holes 61 in the seat. When not needed, two of the hooks at either end of the seat can be removed from the walker frame so that the seat hangs down in a stowed position, as shown by the dashed line position of seat 7 in FIG. 1.

Figure 2:
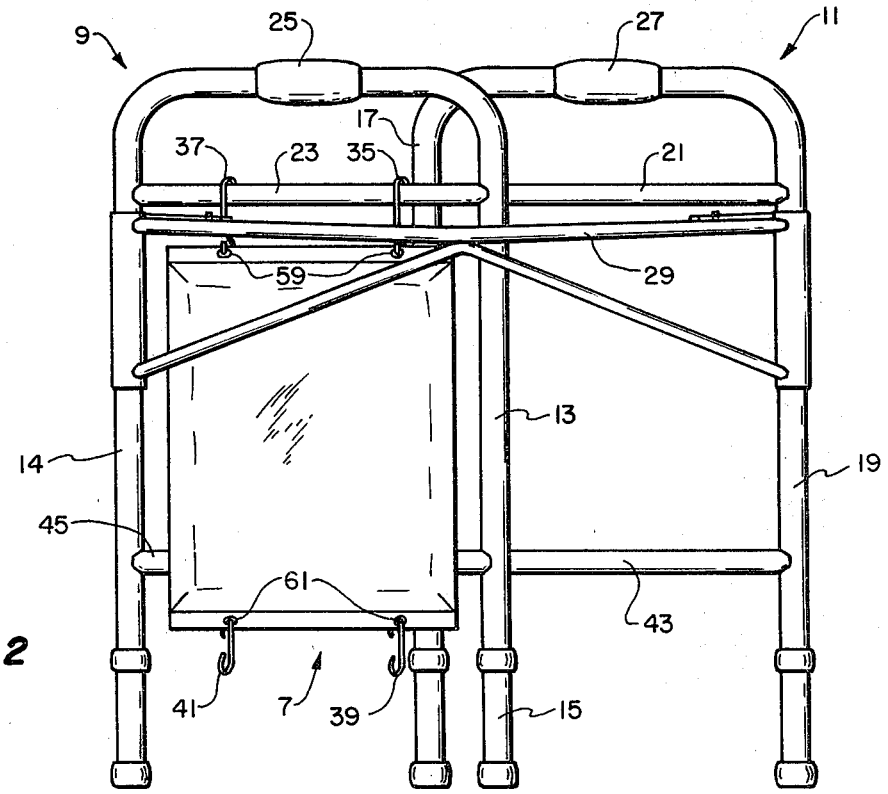
FIG. 2 shows the same walker with the seat stowed thereon and the walker folded.

The folding walker of FIGS. 1 and 2 comprises a pair of similar right and left side frames, 11 and 9 respectively. The right side frame 9 comprises a pair of front and rear upright members 13 and 14 joined at the top by a horizontal member which has a handgrip 25 mounted thereon. Similarly the left side frame 11 comprises uprights 17 and 19 with handgrip 27 on the top horizontal member. The side frames are each braced by a pair of horizontal members, 21 and 43 for theleft side and 23 and 45 for the right side. The lower portions of each of the four upright members can be telescopically adjusted, as at 15, to adjust the height of the walker. The front brace 29 connects the two side frames. The front upright members 19 and 14 of the left and right frames are connected to the front brace 29 by hinges which permit the side frames to be folded into overlapping positions, as shown in FIG. 2, against the brace 29. Levers 31 and 33 are pivotally connected to the under-sides of upper horizontal members 23 and 21, respectively. The opposite ends of these levers engage pins 32 which slide in a slot in front brace 29, to aid in stabilizing the device by locking it in the open position.

The upper horizontal members 21 and 23 of the folding walker of FIGS. 1 and 2 provide a convenient means of suspending the seat 7. If the seat is suspended a few inches below these members, the seat will be about 2½ feet above the ground or floor, more or less, depending on the adjustment of the telescopic upright members. As stated above, hooks of different lengths can be used to vary the seat height. Persons will walking handicaps often find it easier and more comfortable to sit in a seat higher than normal, since this requires less effort to sit down and get up. Thus many users of this invention will prefer a high seat suspended only a few inches below the upper horizontal members of the walker of FIGS. 1 and 2.

FIGS. 3 and 4 show a preferred construction of a seat to be used with the present invention. The seat framework shown in FIG. 3 comprises a rectangular frame made of flat aluminum stock three quarters of an inch wide and one eighth of an inch thick, with diagonal braces 67 and 69 connecting the four corners thereof, as shown. The diagonals are of the same material but are made of 1¼ inch wide stock, one sixteenth of an inch thick. The six separate pieces comprising the four outside members 51, 53, 55, and 57 and the diagonals are held together at the four corners by any suitable means such as rivets or nuts and bolts, as indicated at 71. The diagonals are sandwiched between the other two members at the corners. This construction results in a strong and resilient seat.

A seat designed and constructed for the aforementioned folding walker made by Guardian Products Co. was made approximately 16 inches long and 8 inches wide. Additional bracing as well as support for the upholstery which covers the seat frame may be provided by a wire 65 which is wound around the frame across the width thereof, as shown. Notches, such as shown at 63, may be provided at the outer edge of the longer sides of the frame to retain the wire 65. The shorter sides of the frame contain four holes 59 and 61 near the four corners of the seat frame, for receiving the hooks or other mounting means.

In the cross sectional view of FIG. 4 the complete seat is shown with a cushion 73 mounted atop the frame, with a cover 75 which is wrapped around the entire seat, except for the two shorter frame sides 51 and 57 which contain the mounting holes 59 and 61.

A seat of these dimensions and so constructed provides a large seating area which is safe, convenient and comfortable for disabled persons. Also, persons of average weight when seated will cause the aluminum seat frame to yield somewhat in the middle thereof to provide added comfort and safety. Other means of suspension may be provided, for example, steel cables may be permanently attached to the seat near the four corners thereof, with hooks at the free ends thereof for attachment to the two horizontal members.

These methods of supporting the seat at its four corners and suspending it from strong horizontal members results in a secure and safe seat which can be easily stowed on the walker when not needed or even totally removed. Further, as stated above, it can be retrofitted to existing walkers with little or no modifications thereto. These advantages are not found in any previously known walkers equipped with seats.

FIG. 5 shoas how this seat may be attached to a nonfolding walker. The walker of FIG. 5 is typical of many nonfolding walkers presently on the market. It comprises a generally U-shaped frame comprising two upright members 84 and 88 with the upper portion of the inverted U bent forward to form the top of the walker. The upper generally horizontal left and right side members are referenced as 79 and 77 respectively, and each includes a handgrip, 91 and 89. The front upright members 82 and 86 are connected as shown to the upper side members 77 and 79 to complete the main body of the walker. Horizontal braces 92 and 94 connect the front and rear upright members at a point about one foot above the ground or floor level. It can be seen that the horizontal members 92 and 94 are too low to support a seat of the present type. A seat 75, identical to the seat 7 of FIGS. 1–3 can be suspended from upper horizontal members 77 and 79 from hooks 81, 83, 85, and 87 which are identical to the hooks used with the walker of FIGS. 1 and 2 except that they are longer, since the seat must be suspended from a higher horizontal member. The two front or forward hooks 81 and 87 are located forward of the handgrips and these prevent slippage of these hooks to the rear. A means must be provided however to prevent the two rear hooks 83 and 85 from slipping down the rear upright members. This can be accomplished by means of a collar or bushing 93 mounted near the bends in the top rear of the frame, as shown. A similar collar is required to retain hook 85 in the left side of the walker. The collar may comprise merely a short length of rubber hose having an internal diameter about the same as the outside diameter of the walker tubing, held in place by a clamp. In order to facilitate retrofitting, the rubber hose can be split so that it can be slipped over the horizontal member 79, and an open clamp placed over the rubber hose and tightened. Alternatively, the two rear hooks may be inserted into holes in the frame at the two bends. This modification is shown in the fragmentary view of FIG. 6, which shows hook 83 inserted in hole 96.

The walker of FIG. 5 has all of the previously mentioned advantages of the walker of FIGS. 1 and 2, and it can be retrofitted with a seat with only a minor modification.

While the invention has been described in connection with illustrative embodiments, obvious variations thereto will occur to those skilled in the art, accordingly, the invention should be limited only by the scope of the appended claims.

I claim:

1. A walker described having left and right side frames connected by one or more front horizontal members, said side frames each comprising front and rear upright members connected at their upper ends by a top horizontal member, handgrips mounted near the center of each of said top horizontal members, a rectangular seat detachably suspended inside of said walker from said left and right top horizontal members, said seat being suspended at a convenient seating height by means of four S-shaped hooks which engage four holes located near the corners of said seat, in the metal frame there the two hooks attached to the forward or front side of said seat being hooked over said upper horizontal members in front of said handgrips and the other two hooks located to the rear of said handgrips, and a retaining means to prevent said two other hooks from sliding down said two rear upright members.

2. The walker of claim 1 wherein said retaining means each comprise a section of rubber hose clamped over the walker metal tubing.

3. The walker of claim 1 wherein said rectangular seat has its longer dimension running between said left and right side frames and occupying most of the space between said side frames, said seat having a width approximately equal to half its length, said seat further comprising a metal framework with padding and upholstery thereon, said metal framework having said four holes near the corners thereof, said metal framework being designed to yield somewhat under the strain of a seated person.

4. A walker of the type described comprising left and right side frames, each said side frame comprising one or more horizontal members, a padded and upholstered rectangular seat detachably suspended inside of said walker from one pair of said left and right horizontal members by means of four S-shaped hooks, the long side of said seat extending across the interior of said walker and occupying most of the space between said left and right side frames whereby the height of said seat may be adjusted by choosing said hooks of different lengths and whereby two of said four hooks on one end of said seat may be disconnected from one of said horizontal members so that said seat may hang down along one of said left or right side frames in a stowed position while the user walks with the aid of said walker.

5. The walker of claim 4 wherein said seat comprises a rectangular metal frame with bracing means and padding and upholstery thereon, said metal frame having four holes near the corners thereof,. and wherein said seat is suspended from said horizontal members by means of said four S-shaped hooks engaging said four holes and said horizontal members.

6. The walker of claim 5 wherein said metal frame comprises a pair of long and short flat stock sides arranged in a rectangle with diagonal braces of the same material, and steel wire wound across the short dimension of said rectangular frame, said seat further comprising padded upholstery over most of its top surface, but with the shorter sides of said rectangular frame and its four holes exposed.

7. A seat adapted to be temporarily and detachably suspended within the three-sided framework of a walker to provide a seat for the user thereof while resting between periods of walking and to be stowed in a hanging position from one of the left or right side frames of said walker when the user is walking, said seat comprising a rectangular metal frame of flat stock with diagonal braces of the same material, with steel wire wound around said frame for added strength and support, upholstery comprising padding and a cover on most of the upper side of said frame but with the shorter sides of said rectangular frame being exposed and having two holes in each said shorter side near the corners of said frame, said holes being adapted to receive S-shaped hooks used to suspend said seat from said side frames of said walker.

* * * * *